US010524546B2

(12) United States Patent
Votel et al.

(10) Patent No.: US 10,524,546 B2
(45) Date of Patent: Jan. 7, 2020

(54) SLIDE-ON ANCHOR POINT

(71) Applicant: Tenacious Holdings, Inc., St. Paul, MN (US)

(72) Inventors: Thomas Votel, Sunfish Lake, MN (US); Ian Forte, Crystal, MN (US); Nathan Bohmbach, Lakeville, MN (US); Paul Goudreau, Edina, MN (US)

(73) Assignee: Tenacious Holdings, Inc., St. Paul, MN (US)

( * ) Notice: Subject to any disclaimer, the term of this patent is extended or adjusted under 35 U.S.C. 154(b) by 53 days.

(21) Appl. No.: 15/652,166

(22) Filed: Jul. 17, 2017

(65) Prior Publication Data

US 2018/0303206 A1 Oct. 25, 2018

Related U.S. Application Data

(63) Continuation-in-part of application No. 29/605,822, filed on May 30, 2017, now Pat. No. Des. 824,661, and a continuation-in-part of application No. 29/605,823, filed on May 30, 2017, now Pat. No. Des. 833,142, and a continuation-in-part of application (Continued)

(51) Int. Cl.

| | |
|---|---|
| ***A44B 13/00*** | (2006.01) |
| ***A45F 5/14*** | (2006.01) |
| *A45F 5/00* | (2006.01) |

(52) U.S. Cl.

CPC ..... *A44B 13/0058* (2013.01); *A45F 5/14* (2013.01); *A45F 2005/006* (2013.01)

(58) Field of Classification Search

CPC ..... A45F 5/14; A45F 2005/006; A45F 5/00

See application file for complete search history.

(56) References Cited

U.S. PATENT DOCUMENTS

| | | | |
|---|---|---|---|
| 1,286,610 | A | 12/1918 | Harriman |
| D242,646 | S | 12/1976 | Shorin et al. |

(Continued)

FOREIGN PATENT DOCUMENTS

| | | | |
|---|---|---|---|
| DE | 102013011387 | A1 | 12/2014 |
| EP | 0935515 | B1 | 8/1999 |

(Continued)

OTHER PUBLICATIONS https://www.tweexy.com/, Jul. 29, 2017, 8 pages.

Search Report and Written Opinion for PCT/US2018/28748, dated Jul. 12, 2018, 8 pages.

*Primary Examiner* — Victor D Batson

*Assistant Examiner* — Matthew J Sullivan

(74) *Attorney, Agent, or Firm* — Skaar Ulbrich Macari, P.A.

(57) ABSTRACT

The present disclosure is directed to a slip-on device for creating a safety strap anchor point on a hand tool or other object. The invention comprises a pliable core that is captured by a wheel made of a rigid material. The core has a star-shaped, or other shaped opening, configured to accept an object. The inserted object is compressed against the features of the opening, and the pliable core is thus compressed against the rigid wheel, allowing a firm anchor point to be established. A loop member is rotationally attached to the rigid wheel to provide a location to attach a safety strap by carabineer or other method.

8 Claims, 12 Drawing Sheets

Related U.S. Application Data

No. 29/605,826, filed on May 30, 2017, now Pat. No. Des. 824,662, and a continuation-in-part of application No. 29/605,833, filed on May 30, 2017, now Pat. No. Des. 824,663.

(60) Provisional application No. 62/488,731, filed on Apr. 22, 2017.

(56) References Cited

U.S. PATENT DOCUMENTS

| | | | | |
|---|---|---|---|---|
| 4,558,495 | A * | 12/1985 | Olsen | B23B 45/006 24/16 PB |
| D328,920 | S | 8/1992 | Kimball | |
| 6,540,421 | B1 | 4/2003 | Porcelli | |
| 6,648,197 | B2 * | 11/2003 | Perry | A45F 5/00 224/251 |
| 7,435,889 | B1 | 10/2008 | Heidt | |
| 8,171,602 | B1 * | 5/2012 | Zauhar | A45F 5/00 131/178 |
| 9,027,807 | B2 * | 5/2015 | Kampas | A45F 5/00 224/148.4 |
| 9,585,455 | B2 | 3/2017 | Boyle et al. | |
| 9,775,427 | B2 * | 10/2017 | Moreau | A45F 5/00 |
| 9,968,180 | B2 * | 5/2018 | Moreau | A45F 5/021 |
| 2001/0007392 | A1 | 7/2001 | Sugarman | |
| 2004/0009033 | A1 | 1/2004 | Rieber et al. | |
| 2004/0144739 | A1 | 7/2004 | Marek | |
| 2006/0025711 | A1 * | 2/2006 | Bell | A61F 5/0118 602/21 |
| 2007/0228754 | A1 | 10/2007 | Rankin | |
| 2012/0168472 | A1 * | 7/2012 | Mathews | A45F 3/14 224/162 |
| 2012/0174342 | A1 | 7/2012 | Moreau et al. | |
| 2012/0181310 | A1 * | 7/2012 | McCarthy | A45F 5/00 224/148.1 |
| 2012/0267403 | A1 * | 10/2012 | Ward, Jr. | A45F 5/00 224/219 |
| 2014/0013544 | A1 | 1/2014 | Moreau et al. | |
| 2014/0196258 | A1 | 7/2014 | Votel et al. | |
| 2016/0192766 | A1 | 7/2016 | Moreau et al. | |
| 2018/0132600 | A1 * | 5/2018 | Moreau | B25F 5/02 |

FOREIGN PATENT DOCUMENTS

| | | | |
|---|---|---|---|
| GB | 316851 | A | 8/1929 |
| JP | 2008284633 | A2 | 11/2008 |
| WO | 2011104966 | A1 | 9/2011 |

* cited by examiner

SLIDE-ON ANCHOR POINT

CLAIM OF BENEFIT TO PRIOR APPLICATIONS

This application claims the benefit of U.S. Provisional Application No. 62/488,731 filed Apr. 22, 2017; and such application is hereby fully incorporated by reference herein. This application is also a continuation-in-part of patent application Ser. No. 29/605,822 filed May 30, 2017, a continuation-in-part of patent application Ser. No. 29/605,823 filed May 30, 2017, a continuation-in-part of application Ser. No. 29/605,826 filed May 30, 2017, and a continuation-in-part of application Ser. No. 29/605,833 filed May 30, 2017.

FIELD

The present invention relates generally to creating anchor points for attaching safety lanyards or straps to hand tools. More particularly, the present invention relates to an improved slide-on anchor point.

BACKGROUND

With the increasing expense and weight of portable powered hand tools and the weight in general of many hand tools such as hammers, there came recognition of the penalty associated with dropping such a tool. Powered hand tools often times are damaged when they are dropped, and falling hand and power hand tools can injure persons or property if dropped from an elevated position.

As a result of these circumstances, attachment devices have been devised to secure hand tools from such a drop. Many tools are manufactured with captive holes, to allow the connection of a safety line. Further, lanyards and D-rings have been built into many hand power tools to allow attachment of lines to the tool at one end, and a user's body at the other. For example see U.S. Pat. No. 6,487,756 to Vidal.

Many power and non-power hand tools, however, have no such means of attachment. As a result various methods have been devised to add such an attachment means to a tool that was not originally so configured.

One method is to tape a safety strap to the handle of such a tool. Python Safety, Inc. makes such a tape called Quick-wrap Tape™ for this purpose. Another method is used by Tool Safety Solutions LTD, and involves using a heat sensitive tape to secure a section of strap to the tool, and then apply heat to the tape allowing it to shrink and hold the section of strap in place.

Other methods include using cold shrink rubber sleeves mounted on a removable core to allow the natural constriction of the rubber to create an anchor point as disclosed in application Ser. No. 14/020,929 to Votel, et al. This concept was further expanded in U.S. Pat. Nos. 8,567,290 and 8,567,291 to Moreau to a multi-piece slide-on stopper concept to hold the anchor in place.

A disadvantage of the above tape method is that tape can lose its adhesive properties over time and under harsh environmental conditions, creating uncertainty when the tool safety strap connection might fail.

The heat shrink method has disadvantages as well. The heating step might either damage the handle or section of safety strap being used. If the heat shrink adhesive is over heated, the safety strap might well be weakened by the heating process and the weakened safety strap within the heat shrink adhesive might go undetected. An unexpected failure of the safety strap might then occur. Further, the heating step can release undesirable toxic combustion products. In addition, heat shrink sleeves require use of a thin walled product, required for process safety and optimum rate of heat conduction through the heat shrink material. Such a thin-walled product may not be durable or safe in securing a strap to a heavy hand tool, or supporting the weight of the tool if the tool is dropped.

The cold shrink with removable core method involves multiple pieces and cannot be easily adjusted once in place, and are difficult to deploy in the field. Further, it is a one use product. The slide-on invention by Moreau has multiple pieces and is designed such that the bore that captures the hand tool needs to be smaller than the diameter of the area of the hand tool to which it to be applied. This makes application difficult, and the multiple pieces make installation in the field inconvenient and sometimes impossible. Further, the small circular bore size of the Moreau invention restricts the flexibility of the invention for use in tools with non-circular shapes and varying diameters.

Therefore, there is an unfulfilled need for a better and simpler way of creating an anchor point on a hand tool for attaching a safety strap that can be more easily deployed in the field.

SUMMARY

The present disclosure is directed to tool safety, particularly an improved way of making an anchor point on a hand tool for attaching a safety strap. A preferred embodiment of the invention includes a pliable core portion captured by a wheel. It further includes a loop member, containing an eyelet for attaching a safety strap. The loop member is attached to the outer surface of the wheel and configured such that it may revolve freely about the wheel. The core portion is configured with an opening that is preferably star shaped. The circumference of the outer perimeter of the star shaped opening is preferably larger than the surface of the object to which the anchor point is to be applied. When the invention is pushed on to a portion of the hand tool where an anchor point is desired, the core portion is compressed against the wheel to secure the anchor point. The finger portions of the star shaped core portion also engage the hand tool surface and assist in holding the anchor point secure.

This summary is not intended to limit the scope of the invention, or describe each embodiment, implementation, feature or advantage of the invention.

DESCRIPTION OF THE PREFERRED EMBODIMENTS

It will be apparent to those skilled in the art, that is, to those who have knowledge or experience in this area of technology, which many uses and design variations are possible for the slide-on anchor point disclosed herein. The following detailed discussion of various alternative and preferred embodiments will illustrate the general principles of the invention with reference to the disclosed anchor points. Other embodiments suitable for other applications will be apparent to those skilled in the art given the benefit of this disclosure.

Figure 1:
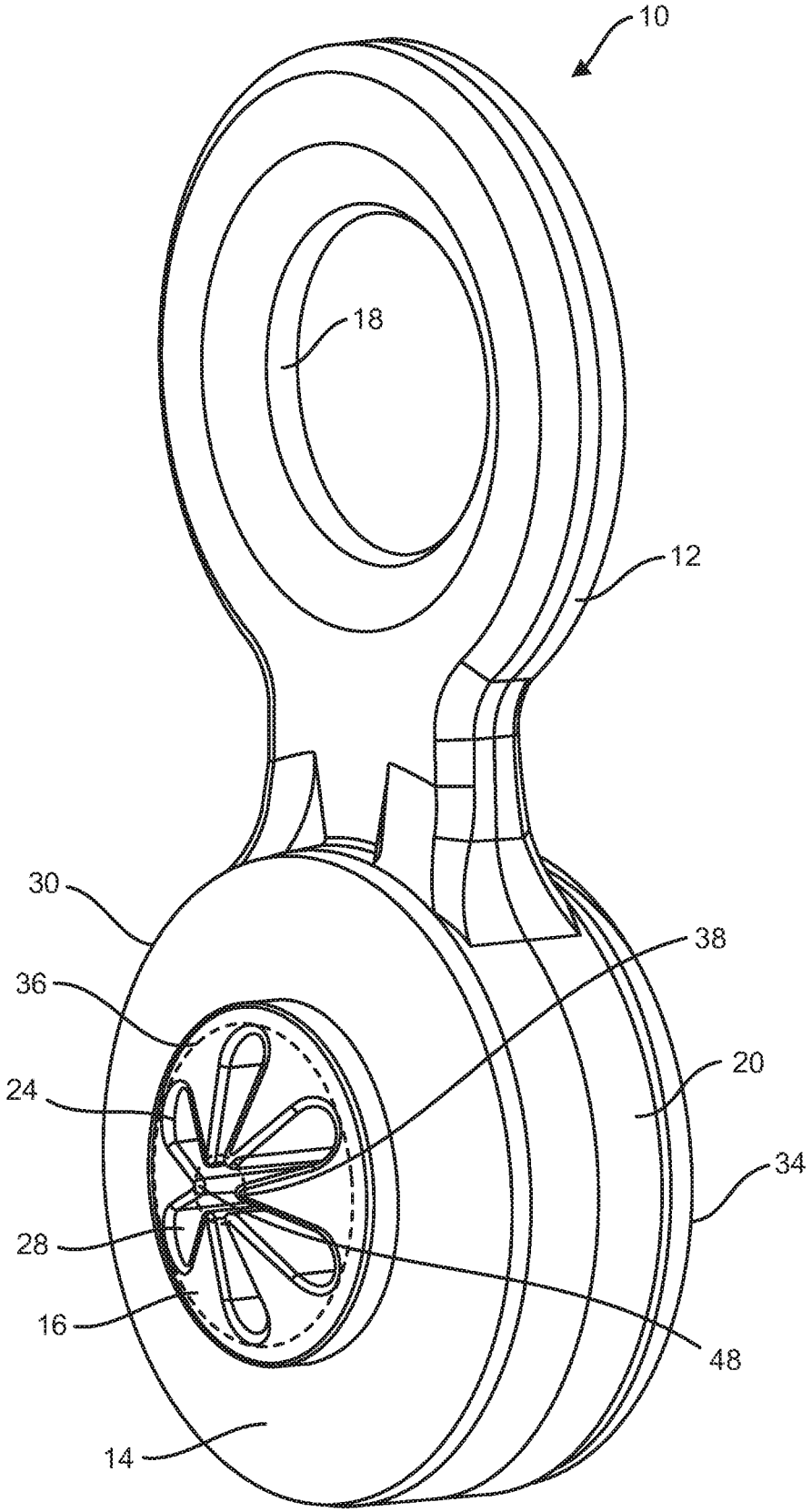
FIG. 1 is a perspective view of a preferred embodiment of the invention.
Figure 2:
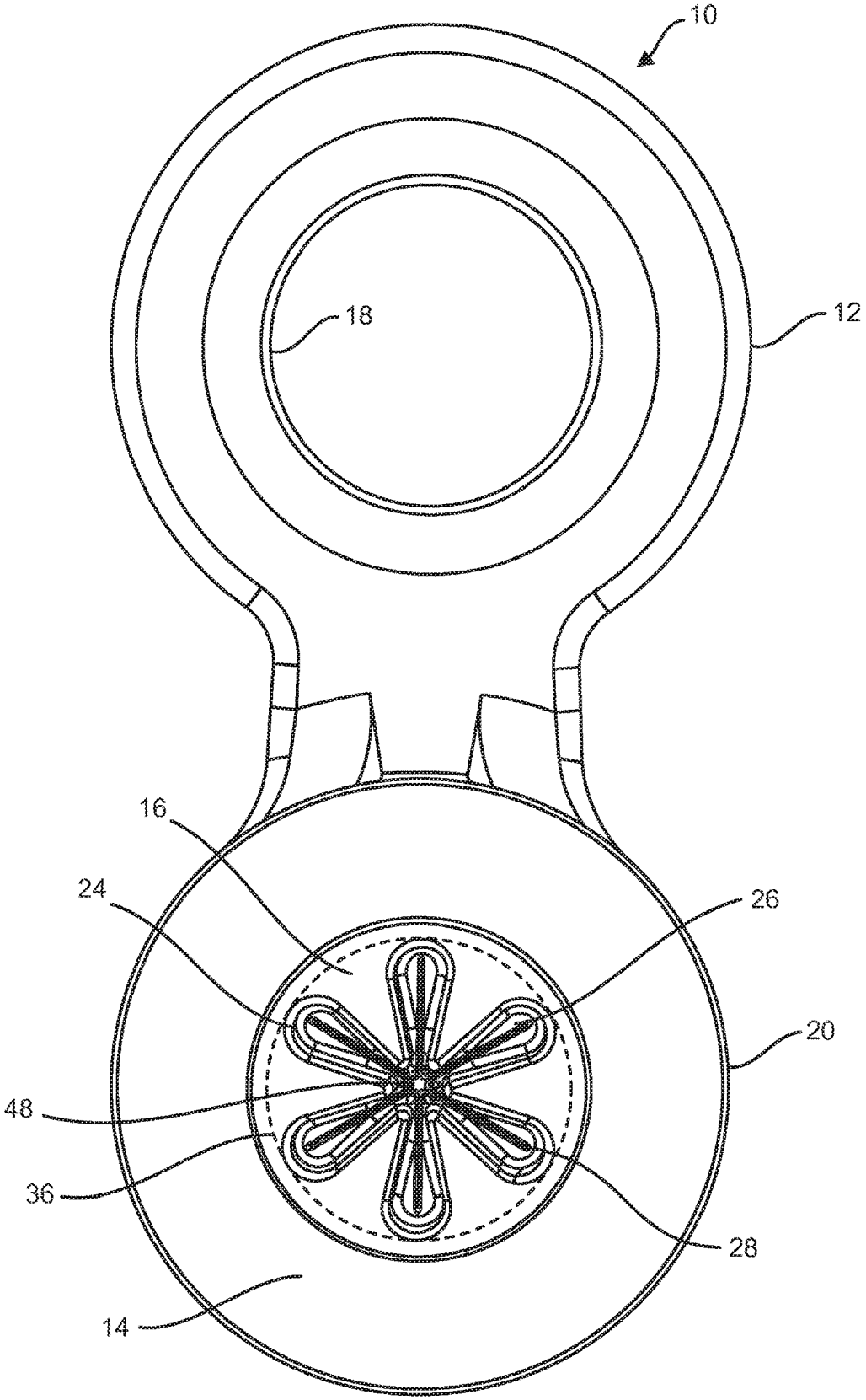
FIG. 2 is a front elevation view of a preferred embodiment of the invention.
Figure 3:
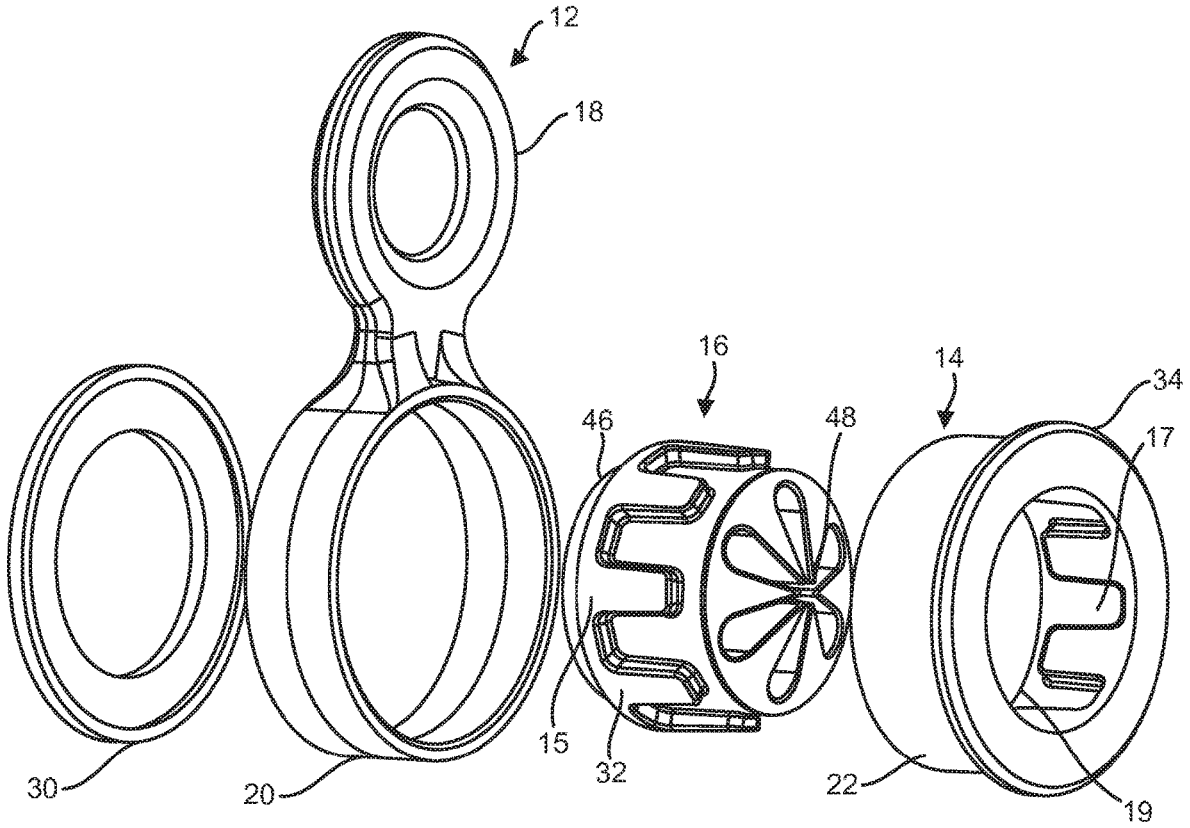
FIG. 3 is a perspective exploded view of a preferred embodiment of the invention.

With reference to the figures, FIGS. 1-3 depict a preferred embodiment of the invention. The basic components of a preferred embodiment of anchor point 10 are loop member 12, wheel 14 and core 16. Loop member 12 comprises eyelet 18 and race engaging member 20. Race engaging member 20 is secured onto wheel 14 such that race engaging member 20 can revolve about wheel 14 on race 22.

Wheel 14 comprises rims 30 and 34 that define race 22. Wheel 14 is preferably constructed of an ABS material (Acrylonitrile-Butadiene-Styrene), but can be made from metal, aluminum, carbon fiber, nylon, other hard plastic or rigid material. Wheel 14 captures core 16 to hold core 16 securely and to constrict the ability of core 16 to expand when engaged with an object to hold the inserted object securely, creating a stable anchor point. Wheel 14 has grooves 17 on its interior perimeter 19.

Core 16 is preferably made of a vulcanized alloy consisting mostly of fully cured EPDM rubber particles encapsulated in a polypropylene matrix (TPV). Core 16 is preferably of a Shore A hardness between 40 and 80. Other rubbers or suitably pliable material may also be used. Core 16 preferably comprises cylinder 32, tongue portions 15 on its exterior diameter 32, star shaped openings 24 and recessed flange 46 The maximum exterior diameter 32 of core 16 is preferably larger than the interior diameter 19 of wheel 14 to insure a firm capture of core 16 by wheel 14. Tongue portions 15 are configured to engage grooves 17 when core 16 is inserted into wheel 14. This engagement serves to inhibit rotational and lateral movement of core 16. Wheel rim 30 serves to engage recessed flange 46 of core 16 to also resist any lateral movement of core 16 after it is captured by wheel 14.

Preferably star shaped opening 24 runs the length of the longitudinal axis of core 16. For larger hand tools or objects the star shaped opening preferably comprises 6 points 48. More or less points, or different spacing of points 48, can be used depending on the application. For example for larger tools or objects, voids 28 can be made larger to increase the amount of material that can be compressed. For smaller tools or objects, for example, it is preferred to use a three pointed star shaped opening (see FIG. 4 for example). A smaller anchor point is more easily manufactured with fewer points, and a lighter tool or object requires less contact points to create a secure anchor point.

It is preferred that the diameter of the portion of the hand tool or other object on which an anchor point is to be established is smaller than the outside diameter 36 of star shaped opening 24. This allows for points 48 to effectively engage the surface of the object inserted into star shaped opening 24 to establish a secure anchor point. The portion of the hand tool or other object on which an anchor point is to be created needs to be larger than inside diameter 38 to create a secure anchor point.

Optionally membrane 26 can be constructed within void 28 of star shaped opening 24 as depicted in FIG. 2. When creating an anchor point on a hand tool or other object, membrane 26 is pierced by the object inserted into star shape opening 24. Pierced membrane 26 supplies additional resistance to movement of the inserted object, and increases stability for the anchor point as it engages the inserted object.

Loop member 12 is preferably constructed from ABS material. Upon assembly, rim 30 is preferably sonic welded to wheel 14.

Figure 4:
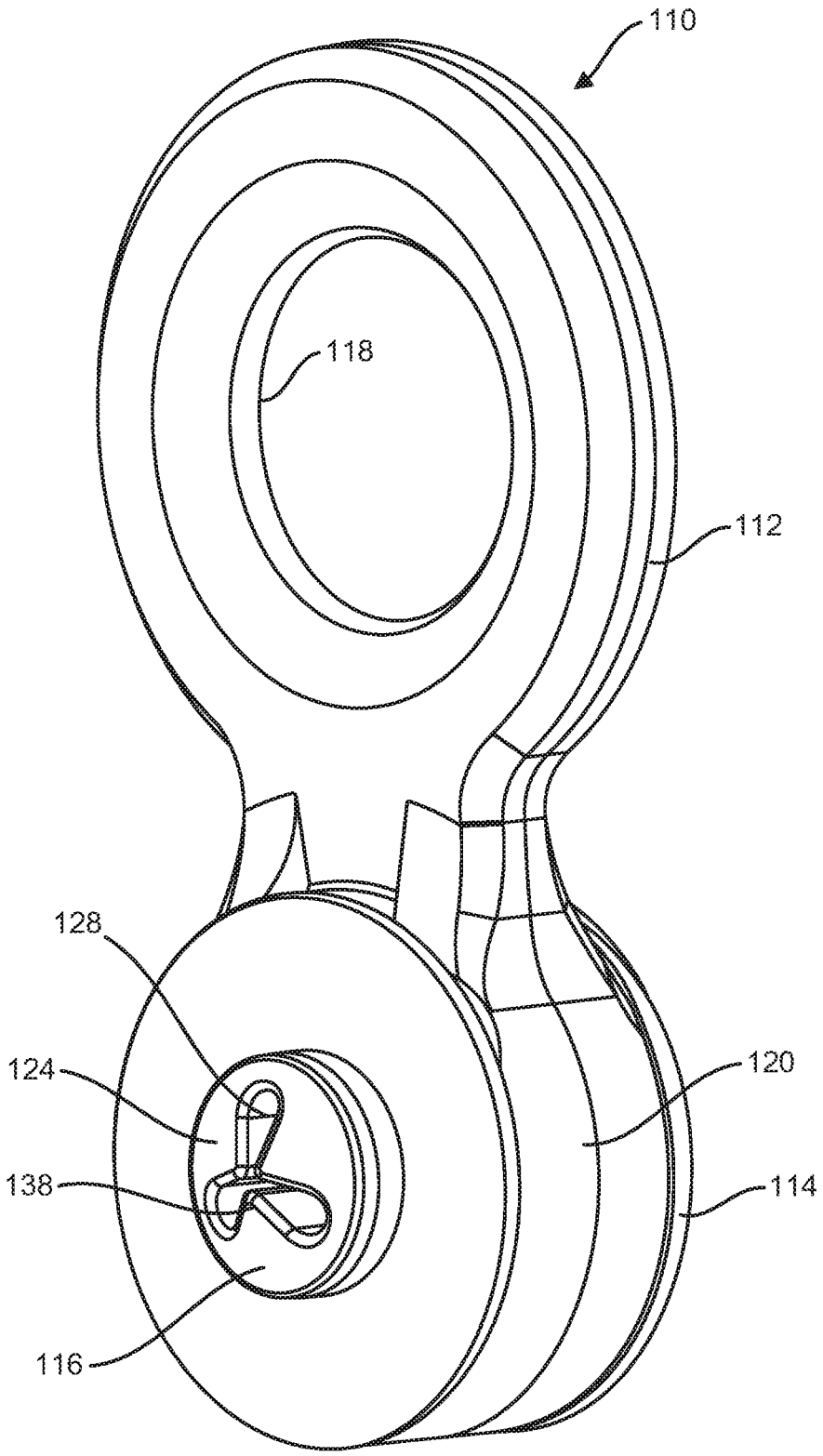
FIG. 4 is a perspective view of a three star embodiment 110 of the invention.

Referring to FIG. 4, anchor point 110 is comprised of loop member 112, wheel 114 and core 116. This embodiment, intended for smaller objects, has star shaped opening 124 that has three points 138 and three voids 128. Loop structure 112 is comprised of eyelet 118 and race engaging member 120.

Figure 5:
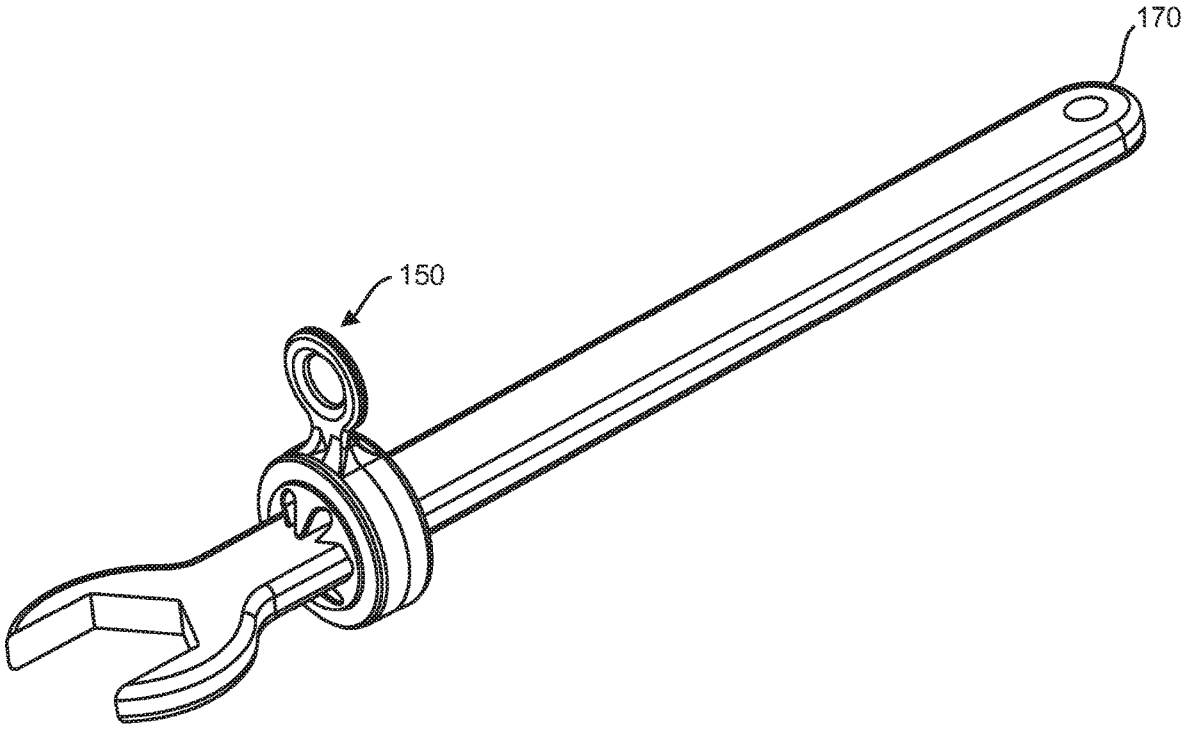
FIG. 5 is a perspective view a preferred embodiment of the invention creating an anchor point 150 on an opened end wrench 170.

Referring to FIG. 5, anchor point 110 is shown attached to an open end wrench 120.

Figure 6:
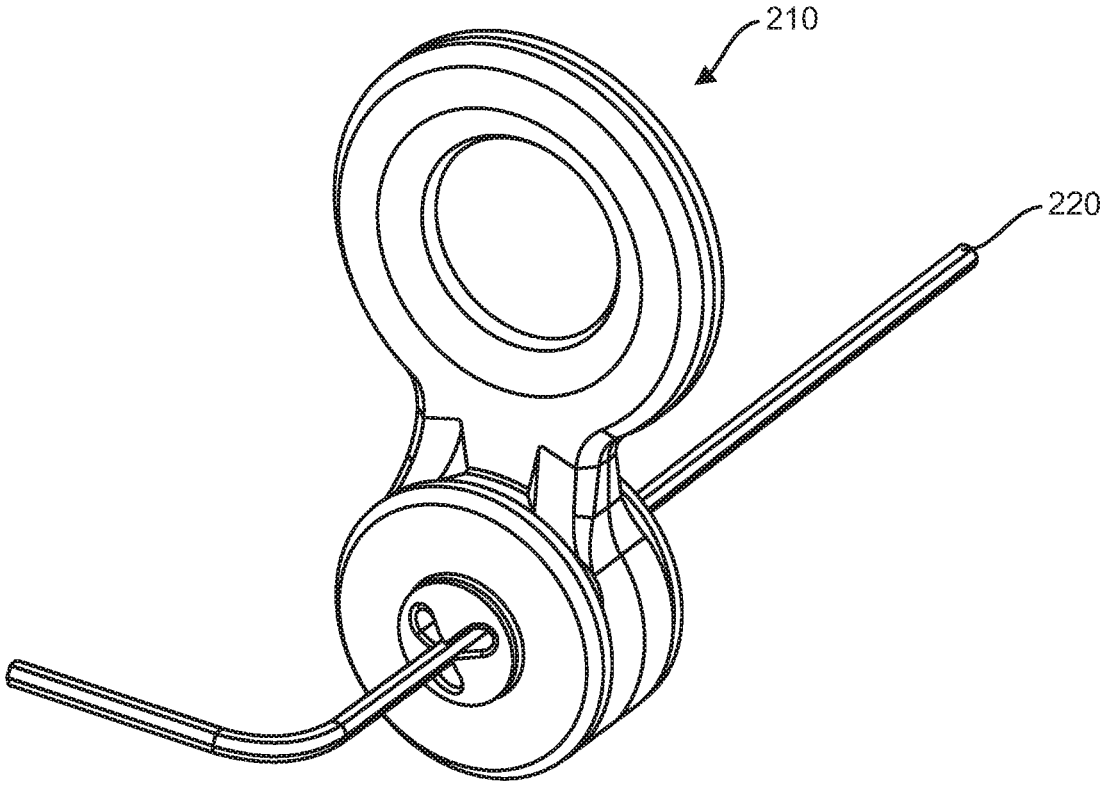
FIG. 6 is a perspective view of three star embodiment 210 creating an anchor point on a hex key wrench 220.

Referring to FIG. 6, anchor point 210 is shown attached to a hex key 220.

Figure 7:
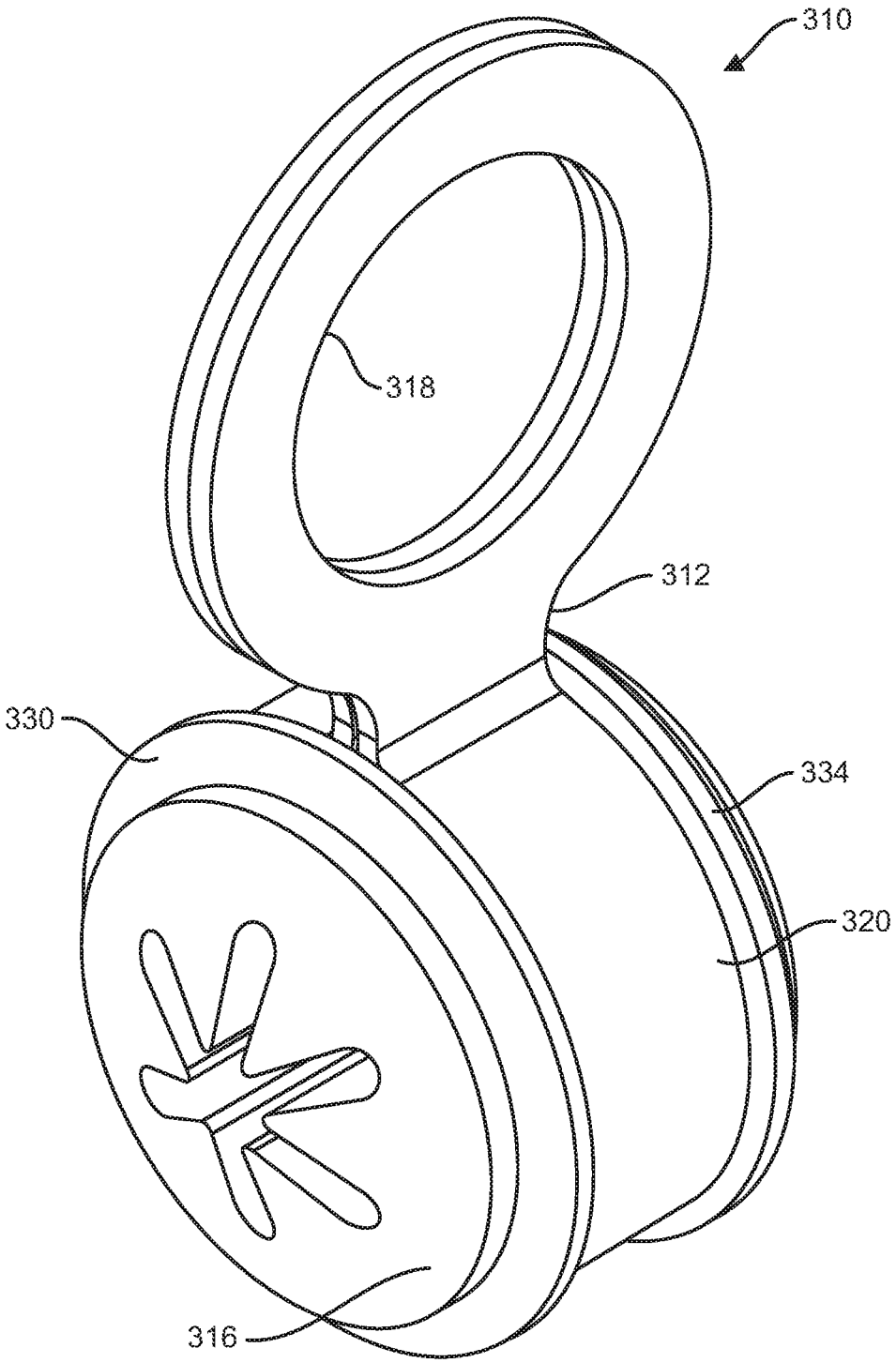
FIG. 7 is a perspective view of an alternate embodiment of the invention showing an alternate loop member 112 configuration on anchor point 310.
Figure 8:
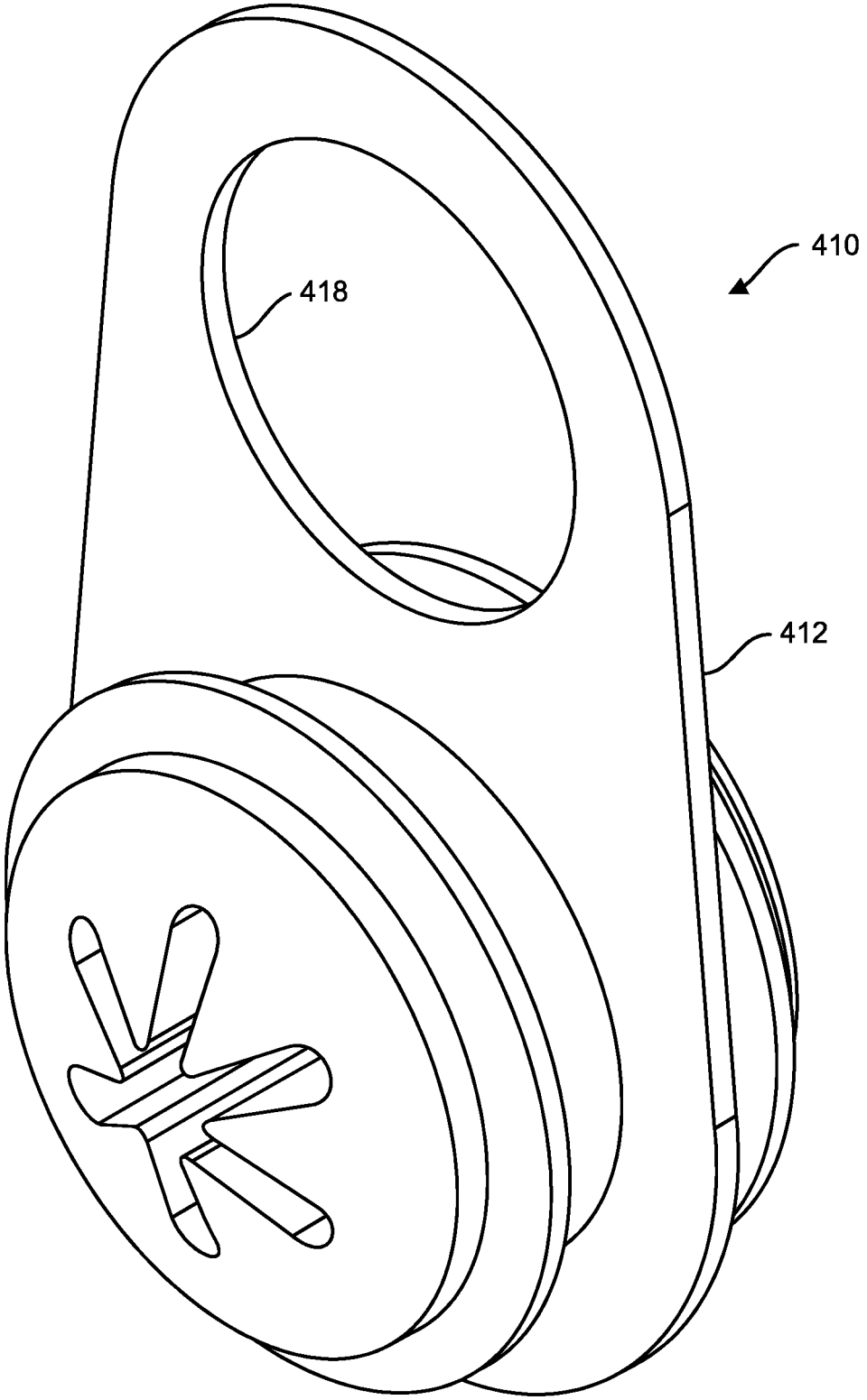
FIG. 8 is a perspective view of an alternate embodiment of the invention showing an alternate loop member configuration 412 on anchor point 410.
Figure 9:
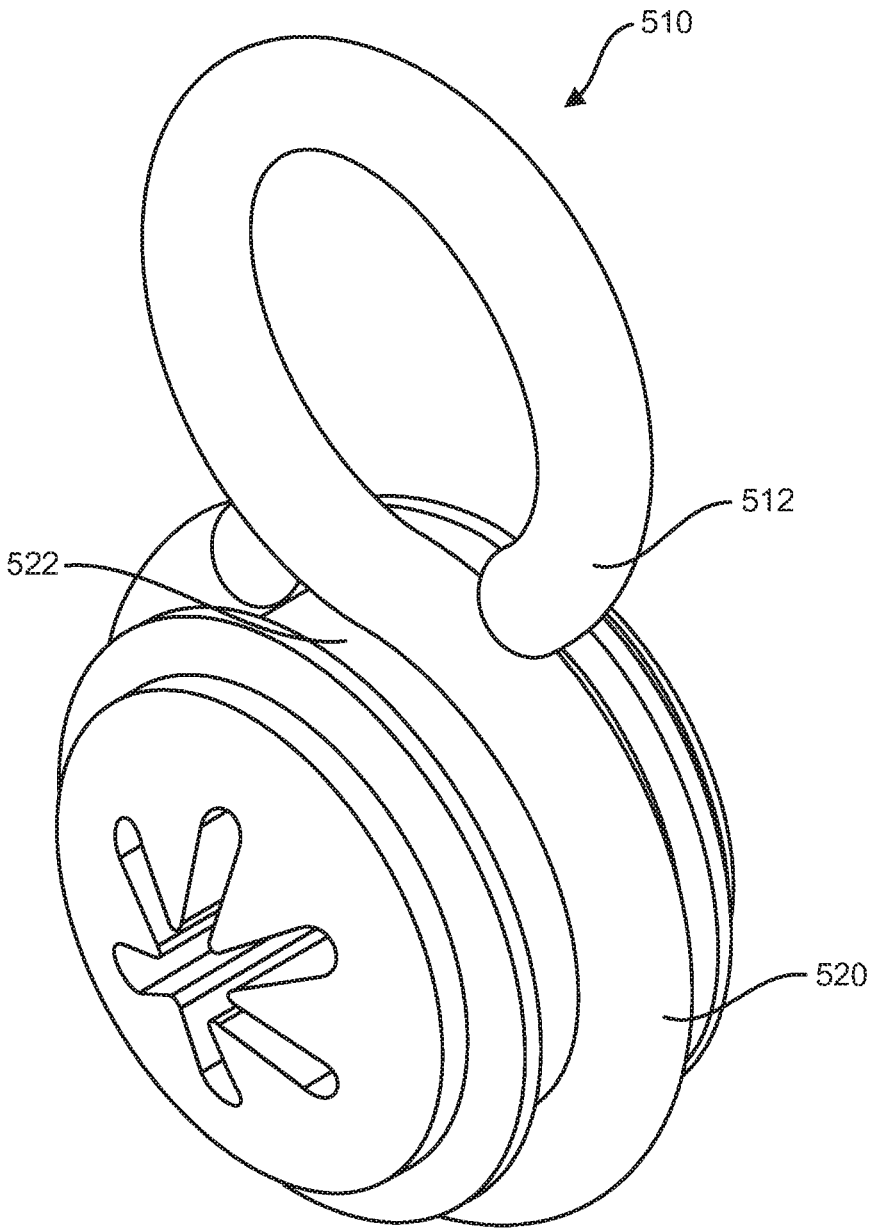
FIG. 9 is a perspective view of an alternate embodiment of the invention showing a different loop member 320 configuration.
Figure 10:
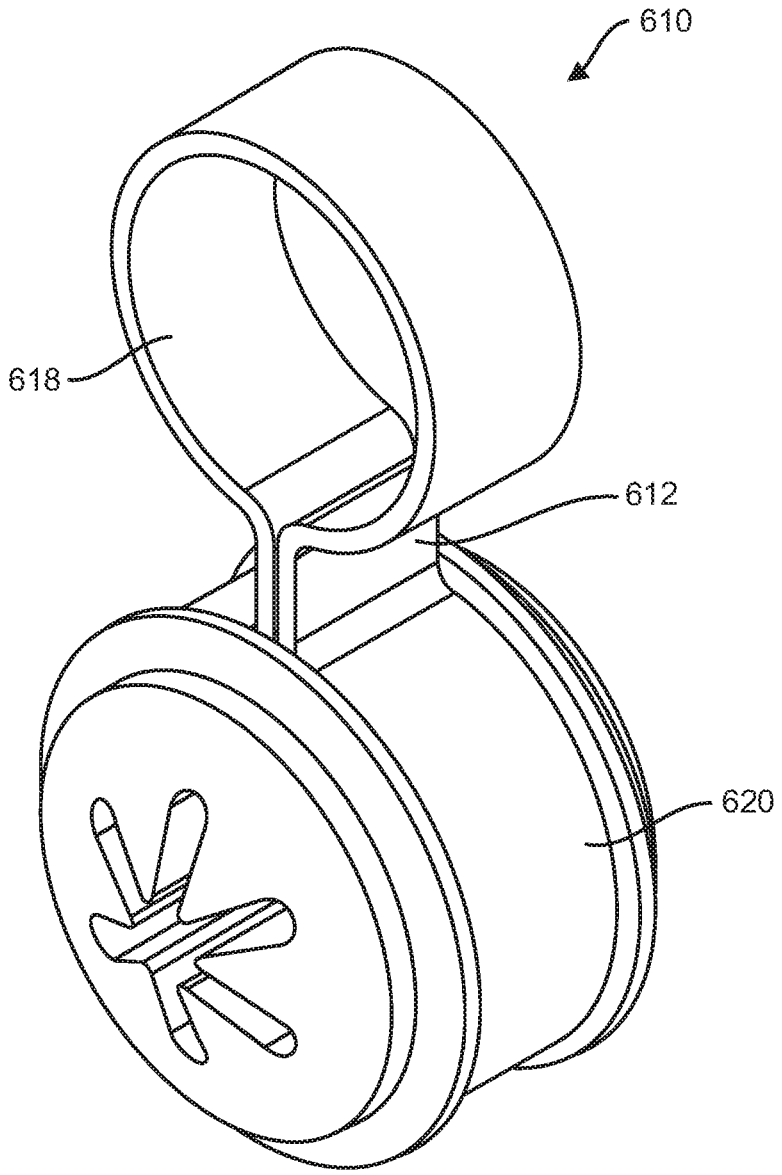
FIG. 10 is a perspective view of an alternate embodiment of the invention showing a different loop member 412 configuration.
Figure 11:
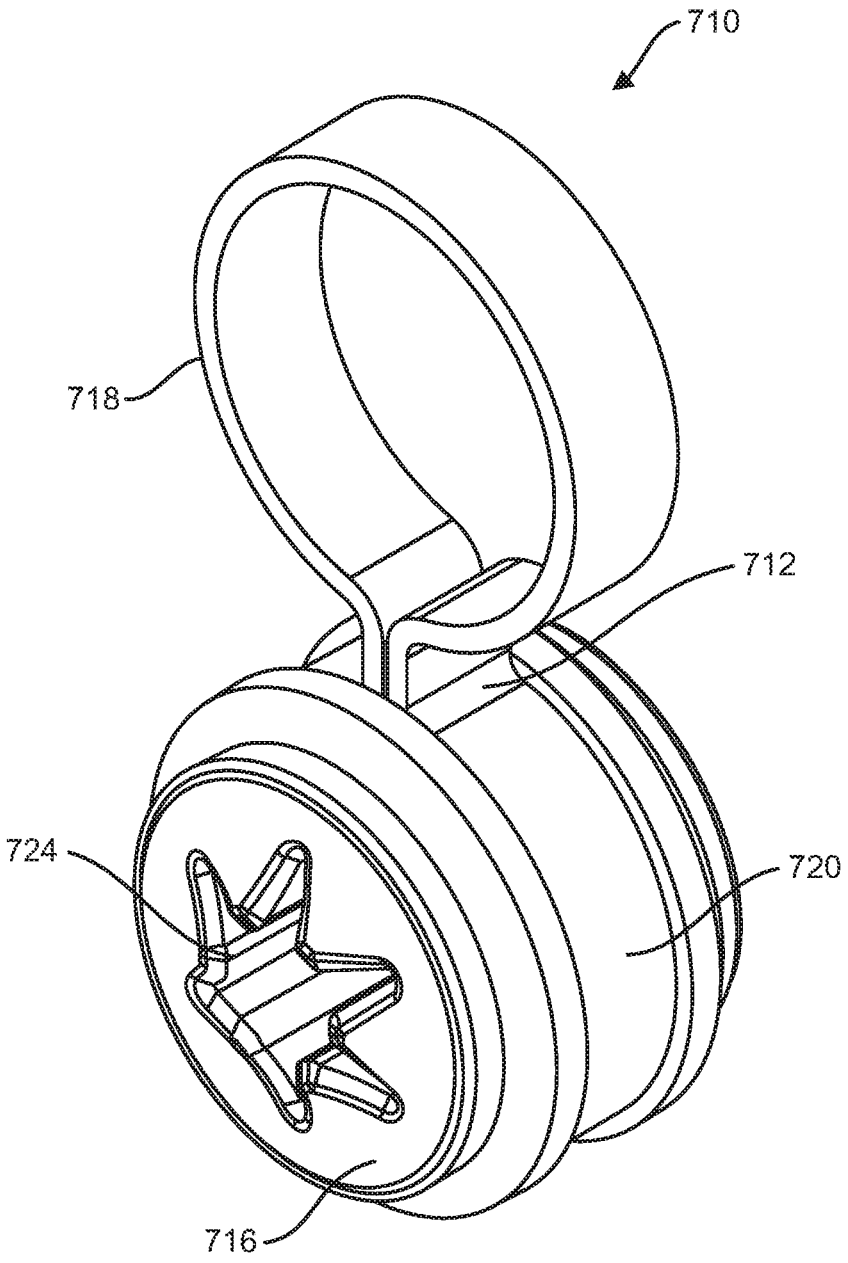
FIG. 11 is a perspective view of an alternate embodiment of the invention showing a different loop member 512 configuration and an alternate star shaped opening 524.
Figure 12:
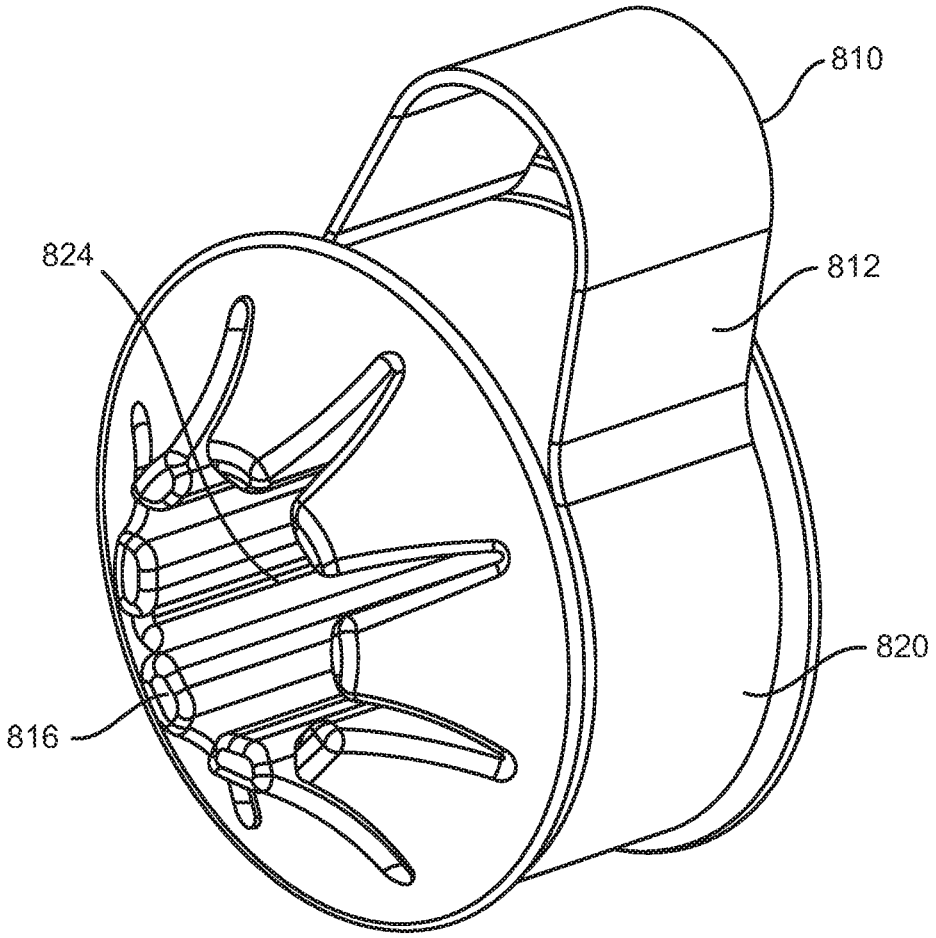
FIG. 12 is a perspective view of an alternate embodiment of the invention showing a different loop member 612 configuration and an alternate shaped opening 624.

Referring to FIGS. 7-12, alternate embodiments of loop members and core openings are depicted. FIG. 7 depicts the plane of eyelet 318 perpendicular to race engaging member 320. Loop member 320 is a split ring configuration, which demonstrates an alternate method of mounting loop member 320 on the race (not visible). FIG. 8 depicts loop member 412 of anchor point 410 in a more planar configuration for use in tighter spaces. FIG. 9 depicts loop member 512 is a tube steel configuration depicting an alternate embodiment and an alternative method of mounting loop member 512 on race 522. FIG. 10 depicts anchor point 610 comprising loop member 612 in a spring steel configuration, which demonstrates an alternate method of mounting loop member 612 to the race (not visible). FIG. 11 depicts anchor point 710 with the spring steel configuration of loop member 712 comprising eyelet 718 and race engaging member 720 (similar to that of FIG. 10) and an alternative opening configuration 724 in pliable core 716. FIG. 12 depicts an alternate embodiment anchor point 810 depicting a lower profile loop member 812 in a spring steel configuration. Also depicted is alternative design of opening 824 in core 816.

While the invention has been described in connection with what is presently considered to be the most practical and preferred embodiments, it will be apparent to those of ordinary skill in the art that the invention is not to be limited to the disclosed embodiments. It will be readily apparent to those of ordinary skill in the art that many modifications and equivalent arrangements can be made thereof without departing from the spirit and scope of the present disclosure, such scope to be accorded the broadest interpretation of the appended claims so as to encompass all equivalent structures and products. Moreover, features or aspects of various example embodiments may be mixed and matched (even if such combination is not explicitly described herein) without departing from the scope of the invention.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. An anchor point for attaching a safety strap to an object comprising:

a one-piece hollow wheel having an interior surface and an exterior surface, the exterior surface having two rims that define a race therebetween on the exterior surface of the one-piece hollow wheel;

a pliable core lockably secured within the interior surface of the one-piece hollow wheel;

an opening in the pliable core, having an outer and inner diameter, the core positioned longitudinally through the approximate center of the pliable core;

a one-piece band rotationally secured to the race of the one-piece hollow wheel, the one-piece band having an integrated eyelet for attaching a safety strap thereto; and, wherein the anchor point is applied to an object without any disassembly of the anchor point or object.

2. The-anchor point of claim 1 wherein the opening is star shaped.

3. The anchor point of claim 1 wherein the opening, at its outer diameter, is larger than the diameter of the object inserted into the opening.

4. The anchor point of claim 1 wherein the opening contains a puncturable membrane.

5. A slide-on anchor point for attaching a safety strap to an object comprising:

a one-piece band including an integrated eyelet for attaching a safety strap to an object;

a pliable center core having an exterior surface and an interior star-shaped portion comprising an opening about the generally longitudinal axis of the pliable center core;

the opening of the pliable center core comprising flexible protrusions;

the pliable center core being lockably confined by its exterior surface within the one-piece band such that the placement of an object within the opening of the pliable center core will allow the compression of the core upon the object to hold the object securely to thereby establish an anchor point on the object; and, wherein the anchor point is established without any disassembly of the anchor point or object.

6. The anchor point of claim 5 wherein the protrusions are symmetrical.

7. The anchor point of claim 5 wherein the pliable core has an exterior surface containing tongue shaped locking protrusions, and where an interior surface of the one-piece band contains grooves configured to accept the tongue shaped locking members.

8. The anchor point of claim 5 wherein the opening contains a puncturable membrane.

* * * * *